United States Patent [19]

Kozawa et al.

[11] 4,368,666

[45] Jan. 18, 1983

[54] METHOD AND CIRCUIT ARRANGEMENT FOR CONTROLLING PRINT TIMING IN A PRINTING APPARATUS

[75] Inventors: Hiroomi Kozawa; Kensei Hosoya, both of Katsuta, Japan

[73] Assignee: Hitachi Koki Company, Limited, Tokyo, Japan

[21] Appl. No.: 223,089

[22] Filed: Jan. 7, 1981

[30] Foreign Application Priority Data

Jan. 12, 1980 [JP] Japan ..... 55-2481
Mar. 18, 1980 [JP] Japan ..... 55-35382

[51] Int. Cl.[3] ..... B41J 1/20

[52] U.S. Cl. ..... 101/93.01; 101/93.03; 101/93.14; 400/157.3

[58] Field of Search ..... 101/93.03, 93.29–93.34, 101/93.01, 93.14; 400/144.2, 144.3, 146, 157.3, 166

[56] References Cited

U.S. PATENT DOCUMENTS 3,806,533 2/1975 Gilbert et al. ..... 101/93.14
3,872,788 3/1975 Palombo ..... 101/93.14
4,189,246 2/1980 Kane et al. ..... 101/93.03 X
4,232,975 11/1980 Kane ..... 400/144.2
4,259,903 4/1981 Arendt et al. ..... 101/93.03
4,278,021 7/1971 Nahano et al. ..... 101/93.03 X

FOREIGN PATENT DOCUMENTS 2249538 5/1975 France ..... 101/93.03

*Primary Examiner*—Edward M. Coven
*Attorney, Agent, or Firm*—Lowe, King, Price & Becker

[57] ABSTRACT

The print timing, with which a print hammer impacts a desired type moving on a type carrier, is advanced and then retarded or vice versa during test printing to find an ideal print timing. The amount of advancing and retarding respectively correspond to the negative and positive tolerance limits of the variation in flight time of the print hammer. During test printing the print timing is further advanced and/or retarded so that printed samples are perfect, and then the timing, which has been further advanced or retarded, is used to determine the ideal print timing. Circuit arrangements for performing the method are also disclosed as embodiments of the invention.

22 Claims, 11 Drawing Figures

FIG. 7 c → MMMMMMMM a → MMMMMMMM b → MMMMMMMM

FIG. 8 c → MMMMMMMM a → MMMMMMMM b → MMMMMMMM

FIG. 9 c → MMMMMMMM a → MMMMMMMM b → MMMMMMMM

METHOD AND CIRCUIT ARRANGEMENT FOR CONTROLLING PRINT TIMING IN A PRINTING APPARATUS

FIELD OF THE INVENTION

This invention generally relates to a printingapparatus, such as a line printer, having a type carrier, and more particularly, the present invention relates to method and circuit arrangement for controlling print timing in such a printing apparatus.

BACKGROUND OF THE INVENTION

In a line printer, one of a plurality of print hammers is selectively driven by a corresponding electromagnet to press an ink ribbon and one or more sheets of paper on a desired type which is disposed on a type carrier, such as a belt, arranged to move around a drive pulley and an idler pulley at high speed. In order to determine the print timing, one of character marks disposed on the type carrier is detected by means of a pickup, and then a corresponding electromagnet is energized. The interval between the time of energization of the electromagnet and the time of actual impact, i.e. the time of printing, is referred to as flight time. The flight time is apt to vary due to various reasons, such as fluctuation of the driving voltage applied to the electromagnet. If the print timing deviates excessively from a desired value, the hammer face of each print hammer cannot cover the entire type face resulting in imperfect printing. Namely, with such incorrect timing characters are printed whose right or left side portions are broken off.

In accordance with a conventional technique, a means for adjusting the print timing is employed, in which the time constant of a monostable multivibrator is adjusted by means of a variable resistor or the like so as to compensate for the variation in flight time. With such a means for adjusting print timing, however, the timing cannot necessarily be set to the most suitable or ideal value with which imperfect printing is prevented even though the flight time varies within a tolerance of flight time variation.Therefore, according to the conventional technique imperfect printing is apt to occur even when the flight time varies only within a tolerance, and thus the print timing has to be readjusted each time such imperfect printing occurs.

SUMMARY OF THE INVENTION

The present invention has been developed in order to remove the above-mentioned drawback or disadvantage inherent to the conventional technique of adjusting the print timing in a printing apparatus having a type carrier.

It is, therefore, a primary object of the present invention to provide a method and circuit arrangement with which print timing is satisfactorily adjusted so that imperfect printing due to variation in flight time is prevented.

Another object of the present invention is to provide a method and circuit arrangement with which print timing is readily set to an ideal value through test printing.

In accordance with the present invention the print timing is advanced and then retarded or vice versa during test printing to find the most suitable or ideal print timing. Namely, test printing is performed with first and second print timings which have been respectively advanced and retarded from a standard print timing as much as a negative tolerance of the flight time of the print hammer in case of advanced print timing, and as much as a positive tolerance of the flight time in case of retarded print timing. During the test printing the print timing is further advanced and/or retarded so that printed characters are perfect. By this adjustment of further advancing and/or retarding, an ideal amount of compensation is found, and thus an ideal print timing is automatically set, after test printing, by either advancing or retarding the standard print timing as much as a value corresponding to the ideal amount of compensation.

BRIEF DESCRIPTION OF THE DRAWINGS

These and other objects and features of the present invention will be more readily apparent from the following detailed description of the preferred embodiments taken in conjunction with the accompanying drawings in which:

FIG. 7, FIG. 8 and FIG. 9 show schematic printed samples obtained as the result of test printing, which is performed according to the present invention;

DETAILED DESCRIPTION OF THE PREFERRED EMBODIMENTS

Figure 1:
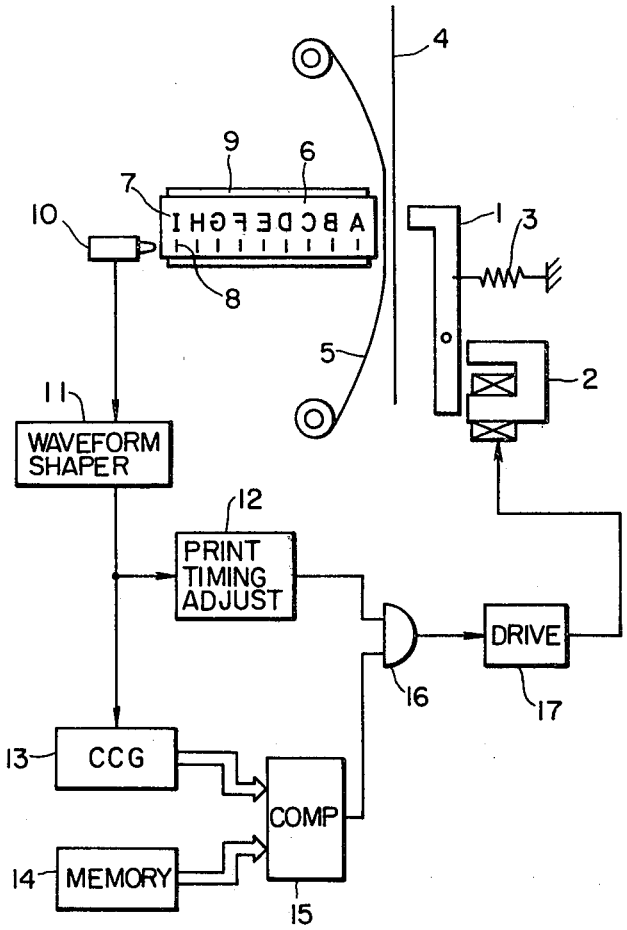
FIG. 1 is a schematic block diagram of a printing apparatus to which the present invention is applicable.

Prior to describing the preferred embodiment of the present invention, the principle of the present invention will be described with reference to FIGS. 1 to 5. FIG. 1 illustrates a schematic block diagram of a printing apparatus, in detail a back impact printer, to which the present invention is applicable.

Although the printing apparatus comprises a plurality of print hammers 1 and corresponding electromagnets 2 for driving each print hammer 1, only one print hammer 1 and one electromagnet 2 are shown for simplicity. The print hammer 1, which is arranged to return to its initial position by means of a return spring 3, faces type characters 7 mounted on a type carrier 6 made of a belt or the like, via (a) printing sheet(s) of paper 4 and an ink ribbon 5. The type carrier 6 is driven at a constant speed by a drive pulley 9 and an idler pulley which is not shown. Character marks 8, which are placed under respective type characters 7 of the type carrier 6, are detected, for instance, by an electromagnetic pickup 10 which generates a detection signal. The detection signal is used, as will be described hereinlater, for determining the print timing of each print hammer 1. The above-mentioned detection signal of the pickup 10 is amplified by a waveform shaping circuit 11, and is also shaped to a square wave to be converted into a character pulse. The character pulse is applied to a print timing adjusting means 12, which adjusts the print timing such that the print hammer 1 hits the type 7 on the above-mentioned moving type carrier 6 at the center of the impact face, which is referred to as a hammer face hereinbelow, after a predetermined flight time from the initialization of driving. The character pulse is also applied to a character code generator 13, which is referred to as a CCG hereinbelow, generating a code of type characters 7 of the type carrier 6 placed in front of respective print hammers 1. A comparator 15 compares, for instance, a print data code from a memory 14 in which a print data code of one line is stored, with the print code from the above-mentioned CCG 13. In case of coincidence, comparator 15 produces a logic "1" signal. The output signal of the comparator 15 is applied via an AND gate 16 with a timing of the output timing signal of the above-mentioned print timing adjust means 12 to a print hammer drive circuit 17 to drive the print hammer 1 by energizing the above-mentioned electromagnet 2.

Figure 2:
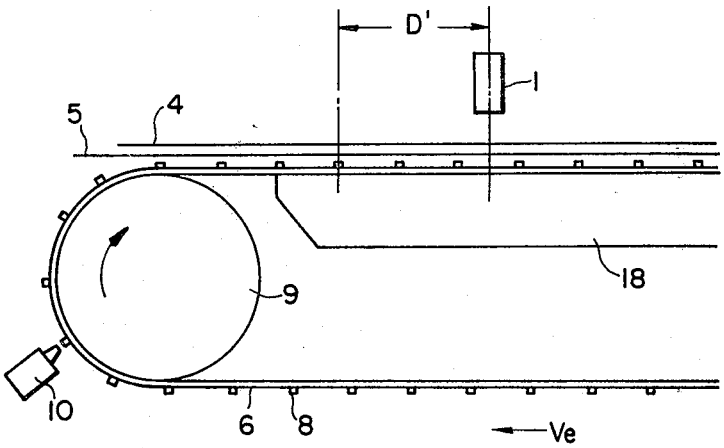
FIG. 2 is an explanatory view useful for understanding a principle of the present invention, especially the relationship between a character mark on a type carrier and a print hammer.

FIG. 2 is an illustration explaining the print timing. A numeral 18 denotes a platen which is mounted in such a manner that it faces the print hammer 1 through the above-mentioned type carrier 6, and which is elongated along the printing positions.

The type carrier 6 moves as much as a distance D from the time of energization of the electromagnet 2 till the above-mentioned print hammer 1 actually impacts a type character 7. Namely, actual printing is performed after the lapse of the above-mentioned flight time. Therefore, the timing of energization of the electromagnet 2 corresponding to a selected print hammer 1 should coincide with the instant that the type character 7 to be hit by the selected print hammer 1 appears at a position which is ahead of the center of the print hammer 1 by the distance D.

As described hereinabove, since the timing of energization of the print hammer 1 and therefore, of the electromagnet 2, is determined by the signal indicative of the presence of the above-mentioned character mark 8, the detection of the character mark 8 should be performed when the character mark 8 is at a point which is spaced from the center of the print hammer 1 by a distance D' which is greater than the distance D. In FIG. 2, the pickup 10 is disposed away from the character mark 8 which is separated from the center of the print hammer 1 by the distance D'. Namely, the pickup 10 detects the character mark 8 which passes in front of the pickup 10, and at this time the type to be impacted by the print hammer 1 is at a point which is ahead of the center of the print hammer 1 by the distance D'. Assuming that the above-mentioned flight time, the interval from the detection of the character mark 8 till the energization of the electromagnet 2, and the running speed of the type carrier 6 are respectively expressed in terms of $t_F$, $t_P$ and Ve, the following equations are satisfied:

$$D = Ve \cdot t_F \quad (1)$$

$$D' = Ve(t_V + t_P) \quad (2)$$

Namely, the timing of energization of the electromagnet 2 for causing the print hammer 1 to impact a type character 7 to be printed corresponds to the end of the interval $t_P$.

Figure 3:
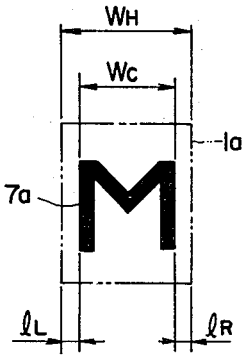
FIG. 3 and FIG. 4 show the relationship between the position of the hammer face of the print hammer shown in FIGS. 1 and 2, and a position of a printed character at the instant of impact.
Figure 4:
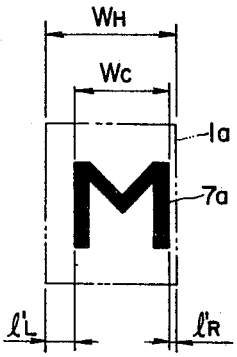

FIG. 3 and FIG. 4 show the relationship between the position of the hammer face of the print hammer 1 at the time that the print hammer 1 impacts against type character 7, and the position of a printed character. Therein a reference 1*a* denotes a hammer face; 7*a*, a character printed on a transfer paper 4; $W_H$, a transverse width of the hammer face 1*a*; $W_C$, a transverse width of the character 7*a*, $l_L$, a distance difference between the hammer face 1*a* and the character 7*a* at the left side; and $l_R$, a distance difference between the hammer face 1*a* and the character 7*a* at the right side. In the above, it is assumed that the type carrier 6 moves in the rightward direction in the drawings.

FIG. 3 shows a case in which the above-mentioned interval $t_P$ has been most suitably adjusted, and FIG. 4 shows a case in which the interval $t_P$ has been set to a value greater than the most suitable value.

On the other hand, the flight time $t_F$ of the print hammer 1 varies, as is well known, for instance, when the driving voltage applied to the electromagnet 2 changes, when the resistance of the coil of the electromagnet 2 changes due to the temperature increase of the coil, or when affected by the leakage magnetic flux from an adjacent electromagnet 2. If the flight time $t_F$ has been changed as much as $\Delta t_F$, the moving distance D'' of the type carrier 6 from the time of detection of the character mark 8 till the print hammer 1 impacts the type 7 by energizing the electromagnet 2 after the interval $t_P$ is given by:

$$D\Delta = Ve(t_P + t_F \pm \Delta t_F) \quad (3)$$

Namely, the printing position deviates as much as $\Delta D' = \pm Ve \cdot \Delta t_F$ with respect to the printing position expressed by Eq. (2).

Assuming that the moving direction of the type carrier 6 of FIG. 2 is of clockwise direction, when $\Delta t_F$ is positive or plus, namely, when $t_F$ has been varied to $(t_F + \Delta t_F)$, as shown in FIG. 4, the deviation is rightward, and on the contrary, when $\Delta t_F$ is negative or minus, namely, when $t_F$ has been varied to $(t_F - \Delta t_F)$, the deviation is leftward.

If $t_F$ has been adjusted to the most suitable value, as shown in FIG. 3, the following relationship is obtained:

$$l_L = l_R = \frac{W_H - W_C}{2} \quad (4)$$

The tolerance of the variation $\Delta t_F$ of the flight time $t_F$, which does not result in imperfect printing, such as the occurrence of broken-off characters, is given by:

$$|\Delta t_F| < \frac{W_H - W_C}{2Ve} \quad (5)$$

However, when the interval $t_P$ has been set from the beginning as shown in FIG. 4, Eq. (5) will not be satisfied because $l'_L \neq l'_R (l'_L > l'_R)$.

For instance, assuming that there is a variation expressed by Eq. (5), right-side-broken-off characters will be printed in case of FIG. 4. In the same manner, if the initial adjusting value is $l'_L < l'_R$ left-side-broken-off characters will be printed.

Figure 5:
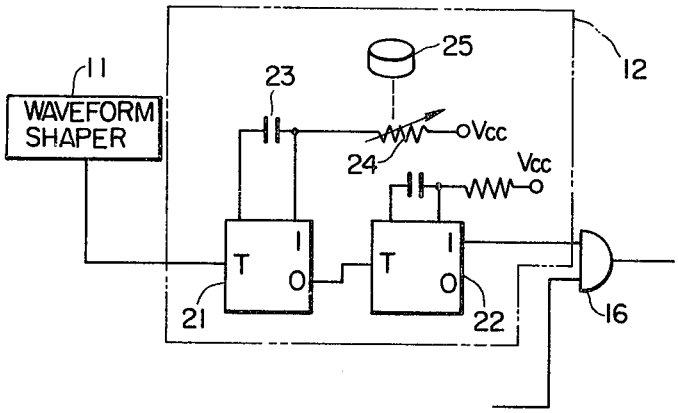
FIG. 5 is a circuit diagram of a conventional circuit arrangement used as the print timing adjusting means of FIG. 1 in a conventional apparatus, and also as used in one embodiment shown in FIG. 11.

FIG. 5 shows an example of the above-mentioned print timing adjusting means 12 which is comprised of monostable multivibrators 21 and 22, an external capacitor 23, an external variable resistor 24 both for the monostable multivibrator 21, and a knob 25 for adjusting the resistance of the variable resistor 24. Assuming that the values of the above-mentioned capacitor 23 and the variable resistor 24 are respectively expressed in terms of C and R, there is a relationship with respect to the time constant $t_P$ of the monostable multivibrator 21 as follows:

$$t_P = KCR \tag{6}$$

wherein K is a constant.

The time constant $t_P$ defines and thus equals the above-mentioned interval $t_P$, and therefore, the interval $t_P$ can be changed by rotating the above-mentioned knob 25 so that the positional relationship between the hammer face 1*a* and the type 7 at the impact instant can be adjusted.

However, with this adjusting method it is very difficult to ascertain from printed samples whether the positional relationship between the hammer face 1*a* and the character 7*a* is close to the state of FIG. 3 or the state of FIG. 4. For this reason, if the interval $t_P$ is adjusted such that the printed character is excessively biased to one side of the hammer face 1*a*, and variation in the above-mentioned flight time $t_F$ occurs, the conventional technique suffers the disadvantages that broken-off characters are apt to be printed, and in the worst case, omission of characters is apt to occur.

The present invention thus provides method and circuit arrangement for simply setting the interval $t_P$ to an ideal value so that imperfect printing is absolutely prevented if the variation in the flight time $t_F$ is within a given tolerance.

Figure 6:
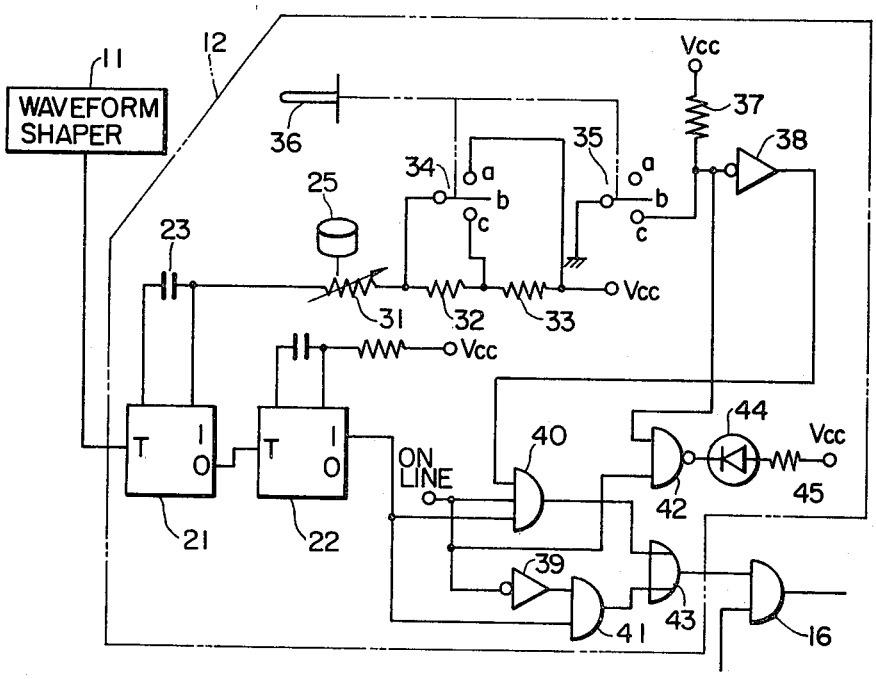
FIG. 6 is a schematic circuit diagram of the print timing adjustment means of FIG. 1 according to a first embodiment of the present invention.

FIG. 6 is a block diagram showing an embodiment of the above-mentioned print timing adjusting means 12 which is arranged such that the method according to the present invention can be adapted, and the same parts as in FIG. 5 are designated at the same references. Reference numerals 31, 32 and 33 designate a variable resistor and fixed resistors which are connected in series to a capacitor 23, and the series circuit is externally connected to a monostable multivibrator 21. The resistances of the above-mentioned resistors 31 to 33 are expressed respectively in terms of $R_1$, $R_2$ and $R_3$. References 34 and 35 designate ganged three-position or triple-throw switches, and the movable contacts thereof are simultaneously controlled by a lever 36. A reference 37 denotes a pull-up resistor; 38 and 39, inverters 40 and 41, AND gates; 42, a NAND gate; 43, an OR gate; 44, a light-emitting diode; and 45, a resistor. A terminal designated at ON LINE is used for receiving a control signal from a control circuit, such as a CPU, and when intended to perform printing, the control signal assumes a value of logic "1".

The first monostable multivibrator 21 has an input terminal for receiving the output signal of the waveform shaping circuit 11, and an output terminal connected to an input terminal of the second monostable multivibrator 22. Both of the first and second monostable multivibrators 21 and 22 have terminals for connecting external circuits, which determine the time constant of respective monostable multivibrators 21 and 22. The external circuit for the second monostable multivibrator 22 has a capacitor (no numeral) connected across the above-mentioned terminals, and a fixed resistor (no numeral) connected between a power supply Vcc and one terminal of the capacitor. With this arrangement the time constant of the second monostable multivibrator 22 is fixed to a constant value. Namely, the second monostable multivibrator 22 keeps its on or logic "1" state for a given period of time so that the electromagnet 2 of FIG. 2 will be energized for the given period of time defined by the time constant of the second monostable multivibrator 22.

The external circuit for the first monostable multivibrator 21 has the aforementioned capacitor 23, the variable resistor 31, and the fixed resistors 32 and 33. These three resistors 31 to 33 are connected in series between a power supply Vcc and one terminal of the capacitor 23, where the connection between these three resistors 31 to 33 is changed by the three-position switch 34 so that the time constant of the first monostable multivibrator 21 varies depending on the position of the movable contact of the switch 34. The time constant of the first monostable multivibrator 21 defines the above-mentioned interval $t_P$, and it will be described hereinbelow how $t_P$ varies.

The movable contact of each of the switches 34 and 35 is arranged to assume three different positions a, b and c. When the movable contact of the switch 34 is in position a, the variable resistor 31 is directly connected to the power supply Vcc. In the same manner, when the movable contact of the same switch 34 assumes the position b, the variable resistor 31 is connected via a series circuit of the two fixed resistors 32 and 33 to the power supply Vcc. In case of position c, the variable resistor 31 is connected via the fixed resistor 33 to the power supply Vcc. In other words, the resistance connected to the capacitor 23 are respectively $R_1$, $(R_1+R_2+R_3)$, and $(R_1+R_3)$ when the movable contact of the switch 34 is in respective positions a, b and c. Thus the time constants expressed in terms of $t_{P(a)}$, $t_{P(b)}$, and $t_{P(c)}$ are given by:

$$\left.\begin{aligned} t_{p(a)} &= KCR_1 \\ t_{p(b)} &= KC(R_1 + R_2 + R_3) \\ t_{p(c)} &= KC(R_1 + R_3) \end{aligned}\right\} \ldots (7)$$

If $(R_1+R_3)$ is set to be equal to the resistance R of the variable resistor 24 of FIG. 5, while $R_2$ and $R_3$ are respectively set such that $$\frac{W_H - W_C}{2V} = KCR_3 = KCR_2,$$

then Eq. (7) wil be rewritten as follows:

$$\left.\begin{aligned} t_{p(a)} &= t_p - KCR_3 = t_p - \frac{W_H - W_C}{2Ve} \\ t_{p(b)} &= t_p + KCR_2 = t_p + \frac{W_H - W_C}{2Ve} \\ t_{p(c)} &= t_p \end{aligned}\right\} \ldots (8)$$

Namely, $t_{P(a)}$ is a value which corresponds to the difference between the lower tolerance limit of the flight time variation and the interval $t_P$ and $t_{P(b)}$ is a value corresponding to the sum of the upper tolerance limit and $t_P$.

Accordingly, if test printing is performed under the condition that the movable contact of the switch 34 is in the positions a and b, namely, the electromagnet 2 is energized respectively with the timing of $t_{P(a)}$ and $t_{P(b)}$, and further the resistance $R_1$ of the variable resistor 31 is adjusted by means of the knob 25 so that broken-off characters do not appear in the printed samples obtained as the result of the test printing, then the time constant $t_{P(c)}$ of the monostable multivibrator 21 obtained after the movable contact of the switch 34 is moved to be in the position c, is the most suitable value because the variable resistance $R_1$, has been suitably set. In other words, $t_{P(c)}$ is such that no broken-off characters are printed even though the flight times $t_F$ varies.

When performing the above-mentioned test printing, it is preferable that a character having a wide width and long horizontal length along the both sides, for instance a character "M" may be satisfactorily used. Furthermore, it is also preferable that the printing speed on test printing is set to a low value so that the flight time $t_F$ does not vary due to the change in the driving voltage of the electromagnet 2. Namely, it is preferable that the printing speed is maintained low by reducing the number of impacts, i.e. the number of printing lines, per unit time.

From the above, it will be realized that the position c should be selected when intended to perform normal printing. The above-mentioned control circuit is arranged to send a logic "1" print instruction signal to the terminal ON LINE as described in the above, and this state that a such a logic "1" signal is sent is referred to as ON LINE state. Since normal printing should be performed only when the movable contact of the switch 34 is in the position c, it is necessary to prohibit normal printing when the movable contact assumes the position a or b. Normal printing is prevented in the following manner.

When the movable contact of the switch 35 is in the position c, an input terminal of the inverter 38 is grounded, and thus the inverter 38 produces a logic "1" signal to enable the AND gate 40. Therefore, in the ON LINE state, the output pulse of the second monostable multivibrator 22 is transmitted via the AND gate 40 and OR gate 43 to the AND gate 16, which is also shown in FIG. 1. On the contrary, when the movable contact of the switch 35 is in the position a or b, the inverter 38 receives a logic "1" level voltage from the pull-up resistor 37 to produce a logic "0" signal with which the AND gate 40 is disabled. In the ON LINE state, the AND gate 41 receives a logic "0" signal from the inverter 39 so that the AND gate 41 is also disabled. This means that no logic "1" output signal from the print timing adjusting means 12 is applied to the AND gate 16 if the movable contacts of the switches 34 and 35 assume the position a or b in the ON LINE state. In other words, in such a condition, printing is prohibited. This condition is abnormal so that the light-emitting diode 44 is provided to indicate such an abnormal condition.

The light-emitting diode 44 operates as follows. Light-emitting diode 44 is interposed between the output terminal of the NAND gate 42 and a power supply Vcc via the resistor 45, where the NAND gate 42 receives the above-mentioned control signal applied to the terminal ON LINE and the voltage at the input terminal of the inverter 38. With this arrangement, the light-emitting diode 44 emits light if the movable contact of the switch 35 is in the position a or b in the ON LINE state.

FIGS. 7 to 9 are printed samples obtained during the above-mentioned test printing. In each of FIGS. 7 to 9, the upper line designated at c are printed samples obtained with the switch 34 switched to the position c, the middle line designated at a are printed samples obtained with the switch 34 switched to the position a, and the lower line designated at b are printed samples obtained with the switch 34 switched to the position b. It is assumed that the type carrier 6 moves in the rightward direction in FIGS. 7 to 9. FIG. 7 shows an example that the above-mentioned period $T_{P(c)}$ has been suitably adjusted so that each character is perfectly printed irrespectively of the position of the movable contact of the switch 34. FIG. 8 shows an example that the above-mentioned period $t_{P(c)}$ has been adjusted to a value which is too low, and therefore, when the movable contact of the switch 34 is in the position a, the left side of the character "M" appears narrower than the actual width because the character "M" is hit under the condition that a portion of the left side thereof is out of the hammer face 1*a* of the print hammer 1. On the other hand, FIG. 9 shows an example in which the above-mentioned period $t_{P(c)}$ has been adjusted to a value which is too high, and therefore, when the movable contact of the switch 34 is in the position b, the right side of the character "M" appears narrower than the actual width because the character "M" is hit under the condition that a portion of the right side thereof is out of the hammer face 1*a* of the print hammer 1.

For ease in understanding the principle of the present invention, in the above-described first embodiment, the positive tolerance limit of the flight time variation has the same absolute value as the negative tolerance limit, however the positive and negative tolerance limits are not necessarily equal to each other. Namely, the positive and negative tolerance limits $\Delta t_F(+)$ and $\Delta t_F(-)$ may be separately set, and thus $T_{P(a)}$ and $t_{P(b)}$ are respectively given by:

$$\left.\begin{aligned} t_{P(a)} &= t_P - \frac{|\Delta t_F(-)| \cdot (W_H - W_C)}{\{|\Delta t_F(+)| + |\Delta t_F(-)|\}Ve} \\ t_{P(b)} &= t_P + \frac{|\Delta t_F(+)| \cdot (W_H - W_C)}{\{|\Delta t_F(+)| + |\Delta t_F(-)|\}Ve} \end{aligned}\right\} \quad \ldots (9)$$

In practice, the flight time $t_F$ variation due to the increase in resistance of the coil of the electromagnet 2 because of the increase in temperature, and due to the decrease in driving voltage of the electromagnet 2 is much greater in the positive direction than in the negative direction, and therefore it is advantageous to adjust the interval $t_P$ by making the difference between $t_{P(a)}$ and $t_P$ greater than the difference between $t_P$ and $t_{P(b)}$.

Figure 10:
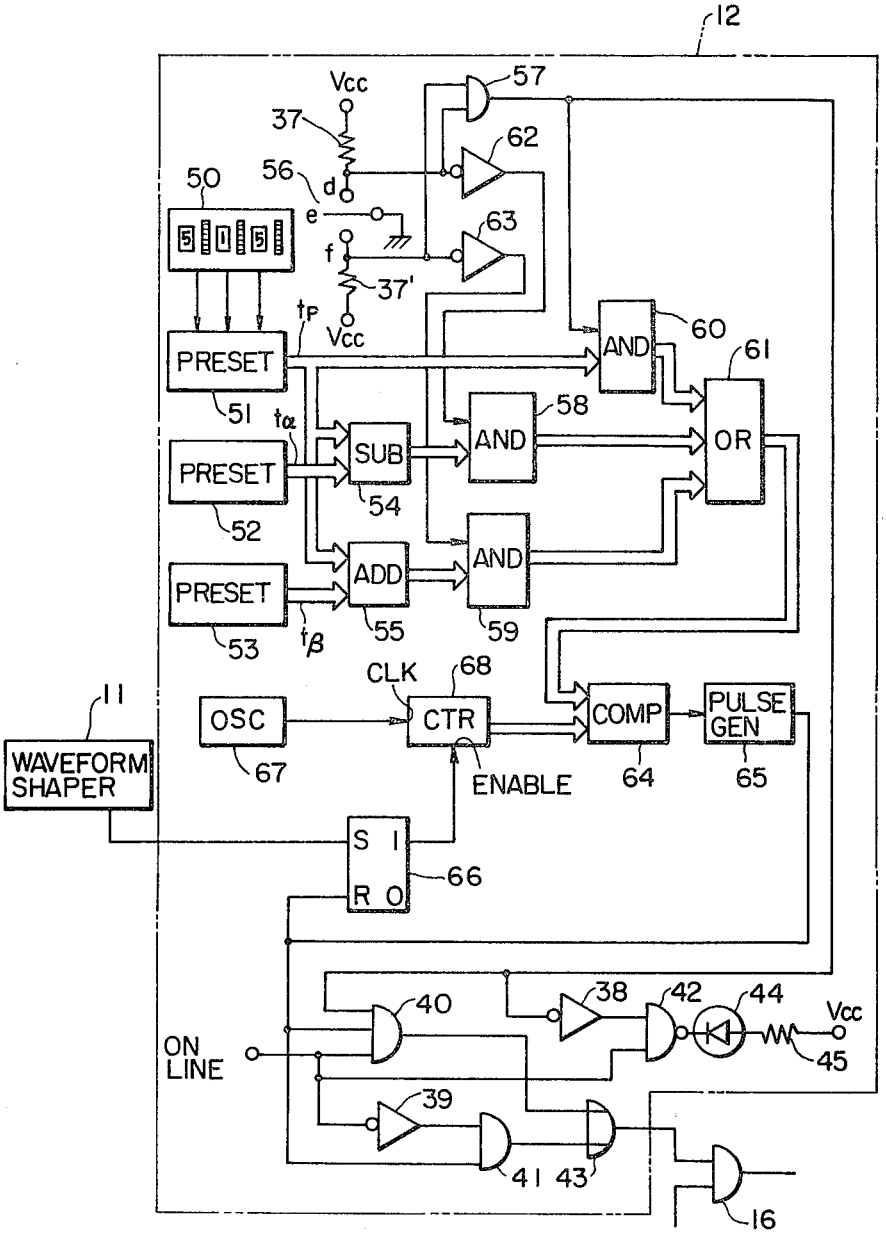
FIG. 10 is a schematic circuit diagram of the print timing adjusting means of FIG. 1 according to a second embodiment of the present invention.

Reference is now made to FIG. 10 which shows a block diagram of a second embodiment of the present invention. Namely, the block diagram of FIG. 10 shows another circuit arrangement for the print timing adjusting means 12 of FIG. 1, and the same elements as in FIG. 5 are designated at like numerals. The circuit arrangement comprises a digital switch 50 and three presetting circuits (memories) 51, 52 and 53. The digital switch 50 functions as an encoder so that a desired value for $t_P$ is manually selected and is preset in the first presetting circuit 51. Accordingly, the output signal of the first presetting circuit represents the interval $t_P$. The second and third presetting circuits 52 and 53 are used for respectively deriving output signals indicative of the intervals $t_\alpha$ and $t_\beta$ respectively corresponding to the tolerance limits of the flight time variations. Namely, $t_\alpha$ and $t_\beta$ are respectively preset in advance in the presetting circuits 52 and 53. A substractor 54 is responsive to the output signals of the first and second presetting circuits 51 and 52 so that the output signal of the subtractor 54 represents $(t_P-t_\alpha)$, while an adder or summing circuit 55 is responsive to the output signals of the first and third presetting circuits 51 and 53 so that the output signal of the adder 55 represents $(t_P+t_\beta)$.

A switching circuit including a switch 56, resistors 37 and 37', an AND gate 57, and two inverters 62 and 63, is provided for selecting one of the output signals of the above-mentioned first to third presetting circuits 51 to 53. In detail, the switch 56 has a movable contact connected to ground, where the movable contact is arranged to assume three positions d, e and f. Namely, a stationary contact d is connected to an input terminal of the AND gate 57, and to an input terminal of the first inverter 62, while another stationary contact f is connected to another input terminal of the AND gate 57 and to an input terminal of the second inverter 63. Both of these stationary contacts d and f are respectively connected via the resistors 37 and 37' to a power supply Vcc. Reference numerals 60, 58 and 59 respectively denote first to third AND gate groups, where these AND gate groups 60, 58 and 59 are respectively enabled by the output signals of the AND gate 57, and inverters 62 and 63. Each of the AND gate groups 60, 58 and 59 comprises a plurality of AND gates responsive to a corresponding input digital signal. It will be seen in FIG. 10 that each of the wide connecting lines respresents a plurality of conductors for transmitting a digital signal. The output terminals of the first to third AND gate groups 60, 58 and 59 are respectively connected to input terminals of an OR gate group 61 including a plurality of OR gates, and then the output terminal of the OR gate group 61 is connected to an input of a digital comparator 64.

A clock pulse generator or oscillator 67 is provided for supplying a counter 68 with a clock pulse train, where the counter 68 is enabled by a logic "1" signal from a flip-flop 66. The counter 68 produces a digital output indicative of a counted number, and then the digital output is fed to the other input of the digital comparator 64. The digital comparator 64 produces an output signal when the values respectively represented by its two inputs equal each other, and the output signal of the comparator 64 is fed to a pulse generator 65, such as a monostable multivibrator or a differentiating circuit. The output terminal of the pulse generating circuit 65 is connected to a reset terminal R of the flip-flop 66, to an input terminal of an AND gate 40, and to an input terminal of another AND gate 41. The flip-flop 66 has a set terminal S for receiving the output signal of the waveform shaping circuit 11 of FIG. 1.

The output terminal of the aforementioned AND gate 57 is connected to an input terminal of the AND gate 40, and to an input terminal of an inverter 38, the output terminal of which is connected to an input terminal of NAND gate 42. The circuit arrangement of FIG. 10 further comprises an OR gate 43, a light-emitting diode 44 and a resistor 45 in the same manner as in FIG. 6 and the connection between these elements 39, 40, 41, 42, 43, 44 and 45 is the same as in FIG. 6. The output terminal of the OR gate 43 is connected to an input terminal of the AND gate 16, which is also shown in FIG. 1.

The circuit arrangement of FIG. 10 operates as follows: Let us assume that the movable contact of the switch 56 is in the position d. In this case, the inverter 62 is supplied with a ground voltage to produce a logic "1" output signal, while the AND gate 57 produces a logic "0" output signal. As a result, only one AND gate group 58 among the first to third AND gate groups 60, 58 and 59 is enabled to permit the transmission of the output signal of the subtractor 54. Therefore, the signal indicative of $(t_P-t_\alpha)$ is fed via the OR gate group 61 to the digital comparator 64 to be compared with the value from the counter 68.

If the movable contact of the switch 56 is in the position e, the AND gate 57 receives logic "1" signals at both inputs thereof to produce a logic "1" output signal. The logic "1" signal from the AND gate 57 is then applied to the first AND gate group 60 to enable the same, while remaining AND gate groups 58 and 59 are disabled. In the same way, if the movable contact of the switch 56 is in the position f, a logic "1" signal is applied from the inverter 63 to the third AND gate group 59 to enable the same, while remaining AND gate groups 60 and 58 are disabled. From the above, it will be understood that one of the output signals of the presetting circuits 51 to 53 is selectively applied to the OR gate group 61 in accordance with the position of the movable contact of the switch 56.

When the electromagnetic pickup 10 of FIG. 1 detects the character mark 8, the waveform shaping circuit 11 produces a logic "1" signal which in turn is supplied to the set terminal S of the flip-flop 66. The flip-flop 66 is set to produce a logic "1" output signal with which the counter 68 is enabled. Namely, the number of clock pulses from the oscillator 67 is counted to produce an output signal indicative of a period of time. With this arrangement the interval from the time of detection of the character marker 8 (see FIG. 1) is compared with one of the preset intervals respectively expressed by $t_P$, $(t_P-t_\alpha)$, and $(t_P-t_\beta)$. When the intervals represented by the output signal of the counter 68 equals the interval represented by the signal from the OR gate group 61, the digital comparator 64 produces a logic "1" signal and thus the pulse generator 65 produces a pulse signal in response to the logic "1" signal from the comparator 64. The pulse signal is applied via one of the AND gates 40 and 41 to the OR gate 43, and therefore to the AND gate 16. Consequently, the pulse from the pulse generator 65 determines the timing of the energization of the electromagnet 2 so that the print hammer 1 impacts a selected type with the timing of this pulse. The pulse from the pulse generator 65 is also applied to the reset terminal R of the flip-flop 66 to reset the flip-flop 66 to zero. When the output signal of the flip-flop 66 turns to logic "0", the counter 68 is disabled and thus the contents of the counter 68 are also rest to zero. Therefore, the counter 68 is able to count up again from zero the next time that it is enabled.

When it is intended to perform a test printing as described hereinabove, the movable contact of the switch 56 is manipulated to be in contact with the stationary contacts d and f one after another. When the movable contact is in contact with either the contact d or f, the output signal of the AND gate 57 assumes a value of logic "0" and thus the AND gate 40 is disabled. At this time if the ON LINE signal from the aforementioned control circuit (not shown) assumes a logic "0"value, the AND gate 41 is enabled to transmit the pulse from the pulse generator 65 to the OR gate 43. This means that test printing can be performed only in the absence of the logic "1" ON LINE signal.

While performing test printing in the above manner, the digital switch 50 is manipulated to select the most suitable interval $t_P$. Namely, the most suitable value of $t_P$ is selected by changing $t_P$ in such manner that the printed samples are prefect as shown in FIG. 7 when the movable contact of the switch 56 is in the position d or f. The second embodiment has an advantage that the interval $t_P$ can be adjusted more accurately as compared to the first embodiment since the value of $T_P$ is expressed by a digital value.

In the above-described first and second embodiments, the period of time between the time of detection of the character marker 8 and a time of energization of the electromagnet 2 is changed in order to find the msot suitable or ideal interval. In other words, the energization timing is made earlier or later than a given timing to this end. However, the most suitable interval $t_P$ may also be found by forcibly changing the flight time $t_F$ the print hammer 1.

Figure 11:
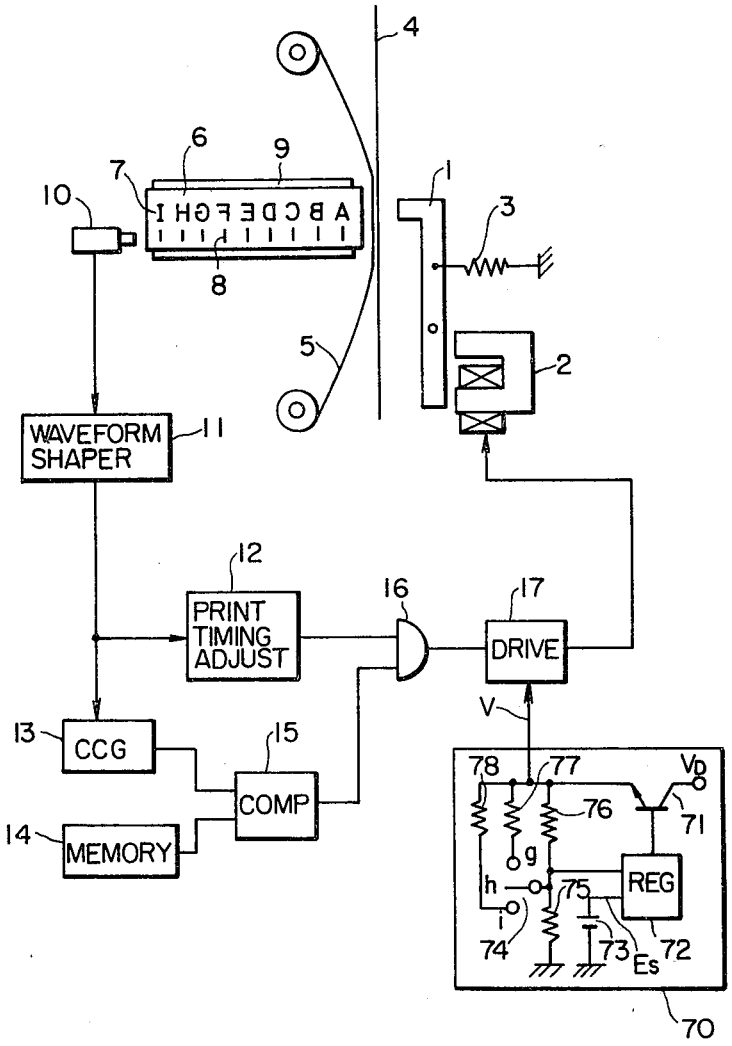
FIG. 11 is a schematic block diagram of a printing apparatus, corresponding to a third embodiment of the present invention.

Hence, reference is now made to FIG. 11 which shows a third embodiment of the invention, in which the flight time $t_F$ is forcibly changed to find the most suitable interval $t_P$. As described hereinbefore, there are several causes for flight time variation. In accordance with the third embodiment, which will be described in detail hereinbelow, the flight time $t_F$ is changed within a tolerance limit of the variation thereof, and then test printing is performed under such a condition. The abovementioned interval $t_P$ may be adjusted and set to the most suitable value by watching the printed samples obtained by test printing so that printed samples are perfect without being broken off. In the following third embodiment, the variation of the driving voltage applied to the electromagnet 2 is treated as the cause of the variation of the flight time $t_F$.

The circuit arrangement of FIG. 11 is basically the same in construction as that of FIG. 1 except that a driving voltage control circuit 70 is additionally provided. The same elements and circuits as in FIG. 1 are designated at like numerals. The circuit arrangement of FIG. 5 may be used as the print timing adjusting means 12. Namely, in the third embodiment of FIG. 11, the circuit arrangement of FIG. 6 or FIG. 10 is unnecessary.

The driving voltage control circuit 70 comprises a voltage regulator 72, a transistor 71, a reference voltage source 73, a three-position switch 74, and resistors 75, 76, 77 and 78. The collector of the transistor 71 is connected to a power supply $C_D$, and the emitter of the transistor 71 is connected to the drive circuit 17. The voltage regulator 72, which may be a well known integrated circuit, has an output terminal connected to the base of the transistor 71. The voltage regulator 71 has first and second input terminals for respectively receiving the above-mentioned reference voltage $E_s$ from the reference voltage source 73 and a variable voltage, and the base current of the transistor 71 is controlled so that the variable voltage equals the reference voltage $E_s$. The emitter of the transistor 71 is connected to the resistor 76, 77 and 78, and the resistor 76 is connected in series with another resistor 75 which is connected to ground at the other end. A junction connecting these resistors 75 and 76 is connected to the second input terminal of the voltage regulator 72 for supplying the above-mentioned variable voltage, and is further connected to a movable contact of the switch 74. The switch 74 has first and second stationary contacts g and i which are respectively connected to the other ends of the resistors 77 and 78.

Assuming that the resistances of the resistors 75 to 78 are respectively expressed in terms of $R_4$, $R_5$, $R_6$ and $R_7$, the voltage developed at the emitter of the transistor 71, namely, the driving voltage V, will be changed by the position of the movable contact of the switch 74 as follows:

$$\left.\begin{aligned} V_{(g)} &= \{R_4 + R_5 \cdot R_6/(R_5 + R_6)\}E_s/R_4 \\ V_{(h)} &= (R_4 + R_5)\,E_s/R_4 \\ V_{(i)} &= \{R_4 + R_5 \cdot R_7/(R_5 + R_7)\}E_s/R_4 \\ V_{(h)} &> V_{(g)} > V_{(i)} \end{aligned}\right\} \quad \ldots (10)$$

wherein $V_{(g)}$ is the driving voltage when the movable contact is in position g;

$V_{(h)}$ is the driving voltage when the movable contact is in position h;

$V_{(i)}$ is the driving voltage when the movable contact is in positoin i; and $R_6 > R_7$:

With this arrangement, the resistances $R_4$ to $R_7$ are selected so that respective flight times $t_{F(g)}$, $t_{F(h)}$, and $t_{F(i)}$ respectively determined by the above driving voltages $V_{(g)}$, $V_{(h)}$ and $V_{(i)}$ have the following relationship:

$$\left.\begin{aligned} t_{F(g)} &= t_F \\ t_{F(h)} &= t_F - \frac{W_H - W_C}{2Ve} \\ t_{F(i)} &= t_F + \frac{W_H - W_C}{2Ve} \end{aligned}\right\} \quad \ldots (11)$$

Namely, when the movable contact is in contact with contact h, the flight time $t_{F(h)}$ equals the tolerance limit of the negative side, and on the other hand, when the movable contact is in contact with contact i, the flight time $t_{F(i)}$ equals the tolerance limit of the positive side.

From the above, it will be understood that the flight time $t_F$ is forcibly changed to the upper and lower tolerance limits by changing the driving voltage V applied via the driving circuit 17 to the electromagnet 2. Under such condition that the flight time $t_F$ is forcibly changed to the upper and lower tolerance limits, test printing is performed to find the most suitable interval $t_P$. Namely, the knob 25 of FIG. 5 is manipulated to change the resistance of the variable resistor 24 in suc a manner that printed samples are perfect irrespectively of the position of the movable contact of the switch 74. As a result, the most suitable time constant for the monostable multivibrator 21 included in the print timing adjusting means 12 is set, where the interval $t_p$ is determined by the time constant. After test printing, the movable contact of the switch 74 is arranged at the upper position g to perform normal printing. Since the interval $t_p$ has been set to the most suitable value, variation in flight time $t_F$ within the upper and lower tolerance limits does not result in occurrence of broken-off characters.

Although, in the above-described third embodiment, the upper tolerance limit of the flight time variation has the same absolute value as the lower or negative tolerance limit for an easy understanding of the principle of the present invention, the positive and negative tolerance limits are not necessarily equal to each other as described in connection with the first embodiment. Namely, the positive and negative tolerance limits $\Delta t_{F(-)}$ and $\Delta t_{F(+)}$ may be separately set and thus $t_{F(h)}$ and $t_{F(l)}$ are respectively given by:

$$\left.\begin{aligned} t_{F(h)} &= t_F - \frac{|\Delta t_{F(-)}| \cdot (W_H - W_C)}{\{|\Delta t_{F(+)}| + |\Delta t_{F(-)}|\}Ve} \\ t_{F(l)} &= t_F + \frac{|\Delta t_{F(+)}| \cdot (W_H - W_C)}{\{|\Delta t_{F(+)}| + |\Delta t_{F(-)}|\}Ve} \end{aligned}\right\} \quad \ldots (12)$$

As described hereinbefore in connection with the first embodiment, the flight time $t_F$ tends to vary in the direction of increasing rather than in the direction of decreasing, thus it is advantageous to set the absolute value of the positive tolerance limit much greater than the absolute value of the negative tolerance limit.

Although, in the above-described third embodiment, the flight time is forcibly changed for performing test printing by changing the driving voltage, other methods may be used in place of such a method. For instance, a variable resistor may be connected in series with the electromagnet 2 to change the current flowing through the winding of the electromagnet 2. The flight time $t_F$ of the print hammer 1 may be varied by changing the current so that the most suitable interval $t_p$ may be selected in the same manner.

From the foregoing description it will be understood that according to the present invention the most suitable interval $t_p$ is easily selected by performing test printing under the condition that the interval between the time of detection of a character mark and the time of printing is changed respectively to the maximum and minimum tolerance limits.

The above-described embodiments are just examples, and therefore, it will be understood by those skilled in the art that many modifications and variations may be made without departing from the spirit of the present invention.

What is claimed is:

1. A method of controlling print timing in a printing apparatus of the type having a type carrier, wherein at least one of a plurality of print hammers is selectively driven by a corresponding electromagnet with print timing which is basically determined by detecting a character mark moving with said type carrier, said electromagnet being energized after a first interval from the time of detection of said character mark, printing being performed after a second interval from the time of energization of said electromagnet, said print timing corresponding to the sum of said first and second intervals, the method comprising the steps of:

(a) performing test printing with first and second print timings which have been respectively advanced and retarded from a standard print timing by an amount as great as a negative tolerance of a variation in said second interval for advanced print timing, and as great as a positive tolerance of a variation in said second interval for retarded print timing, wherein said negative and positive tolerances are amounts of variations of said second interval within which each character can be perfectly printed when said first interval has been set to an optimum value;

(b) further advancing and/or retarding said first and second print timings during said test printing so that printed characters are perfect, a value to be either advanced or retarded from said standard print timing being found by said step of further advancing and/or retarding; and (c) setting an ideal printing timing by either advancing or retarding said standard print timing as much as said value found in said step of further advancing and/or retarding.

2. A method of controlling print timing as claimed in claim 1, wherein said step of performing test printing comprises a step of advancing and retarding said first interval.

3. A method of controlling print timing as claimed in claim 1, wherein said step of performing test printing comprises a step of advancing and retarding said second interval.

4. A method of controlling print timing as claimed in claim 1, wherein said step of further advancing and/or retarding comprises a step of advancing and/or retarding said first interval.

5. A circuit arrangement for controlling print timing in a printing apparatus of the type having a type carrier, wherein at least one of a plurality of print hammers is selectively driven by a corresponding electromagnet with a print timing which is basically determined by detecting a character mark moving with said type carrier, said electromagnet being energized after a first interval from the time of detection of said character mark, printing being performed after a second interval from the time of energization of said electromagnet, said second interval being variable within upper and lower tolerances, said print timing corresponding to the sum of said first and second intervals, the circuit arrangement comprising:

(a) means for producing an output signal responsive to detection of said character mark;

(b) means for adjusting said first interval whose beginning is defined by said output signal, said means for adjusting having a switch means for selecting one interval as said first interval from three different intervals, and means for lengthening and shortening said three different intervals, one of said three different intervals corresponding to a standard value of said first interval, and the two remaining intervals of said three different intervals respectively corresponding to the sum of said standard value of said first interval and the upper tolerance of said second interval variation, and to the difference between said standard value of said first interval and the lower tolerance of said second interval variation, wherein said upper and lower tolerances are amounts of variations of said second interval within which each character can be perfectly printed when said first interval has been set to an optimum value; and (c) means for driving said electromagnet at the end of said adjusted first interval.

6. A circuit arrangement as claimed in claim 5, wherein said means for adjusting comprises a monostable multivibrator, a variable resistor, two fixed resistors, and a capacitor, said switch means arranged to connect a selected one of three combinations of said resistors to said capacitor so as to change the time constant of said monostable multivibrator.

7. A circuit arrangement as claimed in claim 5, wherein said means for adjusting comprises an encoder for encoding a variable interval as said first interval, first memory for storing said first interval, second memory for storing the lower tolerance of said second interval variation, a third memory for storing the upper tolerance of said second interval variation, a subtractor for producing an output signal indicative of the difference between said first interval from said first memory and said lower tolerance from said second memory, an adder for producing an output signal indicative of the sum of said first interval from said first memory and said upper tolerance from said third memory; a gate means for selectively passing one of the output signals of said first memory, said subtractor and said adder; and means for comparing an interval represented by the output signal of said gate means and an interval from the time of detection of said character mark, said means for comparing producing an output signal for defining the end of said first interval.

8. A circuit arrangement as claimed in claim 5, further comprising means for indicating that said circuit is receiving printing instructions when said switch means is connected for selecting an interval corresponding to a value other than said standard value.

9. A circuit arrangement for controlling print timing in a printing apparatus of the type having a type carrier, wherein at least one of a plurality of print hammers is selectively driven by a corresponding electromagnet with a print timing which is basically determined by detecting a character mark moving with said type carrier, said electromagnet being energized after a first interval from the time of detection of said character mark, printing being performed after a second interval from the time of energization of said electromagnet, said second interval being variable within upper and lower tolerances, said print timing corresponding to the sum of said first and second intervals, the circuit arrangement comprising:

(a) means for producing an output signal responsive to detection of said character mark;

(b) means for adjusting said first interval whose beginning is defined by said output signal;

(c) means for adjusting said second interval, whose beginning corresponds to the end of said first interval, said means for adjusting said second interval having a switch means for selecting one interval as said second interval from three different intervals, one of said three different intervals corresponding to a standard value of said second interval, and the two remaining intervals of said three different intervals respectively corresponding to the sum of said standard value of said second interval and the upper tolerance of said second interval variation, and to the difference between said standard value of said second interval and the lower tolerance of said second interval variation, wherein said upper and lower tolerances are amounts of variations of said second interval within which each character can be perfectly printed when said first interval has been set to an optimum value; and (d) means for driving said electromagnet at the end of said first interval.

10. A circuit arrangement as claimed in claim 9, wherein said means for adjusting said first interval comprises a monostable multivibrator, and a series circuit of a capacitor and a variable resistor for determining the time constant of said monostable multivibrator.

11. A circuit arrangement as claimed in claim 9, wherein said means for adjusting said second interval comprises means for changing the driving voltage applied to said electromagnet.

12. A circuit arrangement as claimed in any one of claims 5 to 11, wherein said means for producing an output signal responsive to detection of said character mark comprises an electromagnetic pickup and a waveform shaping circuit responsive to the output signal of said pickup.

13. A printing apparatus having a type carrier, print hammers, and drive means for driving said print hammers, wherein operation of said drive means is initiated after a predetermined adjustment time from detection of a character mark indicating a position of a type character on said type carrier for driving said print hammer, and wherein, after a flight time of said print hammer, a type character on the type carrier is arranged to impact a sheet of paper by means of the print hammer so as to print on said paper, said printing apparatus comprising:

a control means for controlling the predetermined adjustment time corresponding to an interval from the detection of a character mark until initialization of the operation of said drive means; and a means for adding or subtracting a period corresponding to a tolerance limit of the flight time variation to or from said predetermined adjustment time, wherein said tolerance limit is an amount of variation of said flight time within which each character can be perfectly printed when said adjustment time has been set to an optimum value.

14. A printing apparatus having a type carrier, print hammers, and drive means for driving said print hammers, wherein operation of said drive means is initiated after a predetermined adjustment time from detection of a character mark indicating a position of a type character on said type carrier for driving said print hammer, and wherein, after a flight time of said print hammer, a type character on the type carrier is arranged to impact a sheet of paper by means of the print hammer so as to print on said paper, said printing apparatus comprising:

a control means for controlling the predetermined adjustment time corresponding to an interval from the detection of a character mark until initialization of the operation of said drive means; and a means for varying a factor, which causes the variation of said flight time of said print hammer, to the tolerance limit of said flight time, wherein said tolerance limit is an amount of variation of said flight time within which each character can be perfectly printed when said adjustment time has been set to an optimum value.

15. In a printing apparatus having a type carrier, a plurality of print hammers and drive means for driving said print hammers to impact against a sheet of paper after an impact time, said drive means initiated after a first time interval following detection of a character mark indicating a position of a type character on said type carrier, wherein the type character is positioned to impact a sheet of paper responsive to and following a flight time of said print hammer, said impact time comprised of said first time interval and said flight time, the printing apparatus being operative for providing properly registered and imprinted characters for flight times of said hammers within an acceptable range of values between upper and lower limits representing positive and negative tolerances of deviation from an ideal flight time, the improvement comprising:

control means for assuring proper imprinting of characters notwithstanding variations in said flight times, including:

means for advancing and retarding a set impact time by an amount not exceeding the negative and positive tolerances, thereby to determine whether the apparatus is operative within its acceptable positive and negative deviations from its set impact time, and means for adjusting the set impact time to a new value by retarding or advancing the impact time by an incremental value so that the printing apparatus is operative for providing proper registration and imprinting of characters for impact times varying by said positive and negative tolerances of deviation from said adjusted new value of said impact time.

16. A printing apparatus as recited in claim 15 wherein said means for advancing and retarding comprises means for advancing and retarding said first time interval.

17. A printing apparatus as recited in claim 15 wherein said means for advancing and retarding comprises means for adjusting a power supply for said drive means thereby adjusting said flight time.

18. A printing apparatus as recited in claim 15 wherein said means for adjusting the set impact time comprises means for adjusting said first time interval.

19. A method of controlling impact timing of a print hammer in a printing apparatus, having a type carrier and adjustable impact timing, to be within acceptable tolerance limits with charging operating conditions, comprising the steps of:

(a) advancing or retarding the impact timing from a set timing value therefor by an amount of time not exceeding the maximum negative or positive tolerance therefor;

(b) determining whether the advanced or retarded set timing value is within the acceptable tolerance limits;

(c) obtaining an incremental value of time by which the advanced or retarded set timing needs to be retarded or advanced, respectively, to be within the acceptable tolerance limits; and (d) adjusting a new impact timing value for the print hammer by retarding or advancing the previous set timing value by the obtained incremental value.

20. A method of controlling impact timing as recited in claim 19 wherein said determining step comprises the further steps of performing a test printing and detecting an improperly printed character.

21. A method of controlling impact timing as recited in claim 20 wherein said step of obtaining an incremental value comprises the further steps of retarding or advancing the impact timing of the print hammer, and detecting the minimum amount of retardation or advancement necessary to avoid printing of improperly printed characters.

22. A method of controlling impact timing as recited in claim 21 wherein said step of retarding or advancing the impact timing of the print hammer is performed during the step of performing a test printing and said step of detecting the minimum amount of retardation or advancement comprises the step of detecting a printing of a properly printed character.

* * * * *